US012116750B2

(12) United States Patent
Thompson

(10) Patent No.: US 12,116,750 B2
(45) Date of Patent: Oct. 15, 2024

(54) ANTI-RELEASE MECHANISM

(71) Applicant: Caterpillar Inc., Peoria, IL (US)

(72) Inventor: Mark W. Thompson, Manhattan, KS (US)

(73) Assignee: Caterpillar Inc., Peoria, IL (US)

( * ) Notice: Subject to any disclaimer, the term of this patent is extended or adjusted under 35 U.S.C. 154(b) by 150 days.

(21) Appl. No.: 17/866,991

(22) Filed: Jul. 18, 2022

(65) Prior Publication Data

US 2024/0018739 A1 Jan. 18, 2024

(51) Int. Cl.
*E02F 3/36* (2006.01)
*E02F 3/32* (2006.01)

(52) U.S. Cl.
CPC ..... *E02F 3/3618* (2013.01); *E02F 3/32* (2013.01); *E02F 3/3622* (2013.01); *E02F 3/3659* (2013.01); *E02F 3/3663* (2013.01)

(58) Field of Classification Search
None
See application file for complete search history.

(56) References Cited

U.S. PATENT DOCUMENTS

| | | | | |
|---|---|---|---|---|
| 6,508,616 | B2 * | 1/2003 | Hung | E02F 3/3618 37/468 |
| 8,347,974 | B2 | 1/2013 | Calvert et al. | |
| 8,556,534 | B2 | 10/2013 | Lim et al. | |
| 8,602,676 | B2 | 12/2013 | Stollery et al. | |
| 8,684,623 | B2 | 4/2014 | Robl et al. | |
| 9,670,642 | B2 | 6/2017 | Pesch et al. | |
| 2011/0286788 | A1 | 11/2011 | Sikorski et al. | |
| 2018/0355579 | A1 | 12/2018 | Rider et al. | |

FOREIGN PATENT DOCUMENTS

| | | |
|---|---|---|
| CN | 213805532 U | 7/2021 |
| WO | 2021187632 A1 | 9/2021 |

OTHER PUBLICATIONS

Written Opinion and International Search Report for Int'l. Patent Appln. No. PCT/US2023/068659, mailed Sep. 8, 2023 (10 pgs).

* cited by examiner

*Primary Examiner* — Michael S Lowe

(57) ABSTRACT

An anti-release mechanism of a pin-grabber coupler securing a work tool connected to a work machine is disclosed. The anti-release mechanism comprises an actuator, a wedge, a latch, a guide rod connecting the wedge and the latch, and a bias member on a first guide rod end of the guide rod biasing the latch and the wedge together. The wedge and the latch lock around a pin of the work tool and maintain the wedge against the pin of the work tool during a loss of engagement force of the wedge against the pin.

19 Claims, 10 Drawing Sheets

ANTI-RELEASE MECHANISM

TECHNICAL FIELD

The present disclosure generally relates to locking mechanisms in a work machine, and more particularly, relates to anti-release mechanisms of quick couplers connecting to pin-on work tools.

BACKGROUND

Work machines such as excavators, backhoes, skid steers, wheel loaders, tractors, etc., are often provided with a quick coupler that is used to attach and detach various work tool attachments or implements to the work machine. More specifically, such work machines often include a hydraulically movable boom or arm with such implements being connected at an end of the boom. Generally, quick couplers are heavy-duty industrial components that allow for the fast and efficient changing of buckets, hammers, grapples, compactors, rakes, and other implements to the boom of the work machine. Without a quick coupler, workers are required to manually disconnect work tools or work implements from a standard coupler, necessarily making their work less efficient.

Pin-grabber couplers are a type of quick coupler that connects to pin-on work tools. Generally, pin-on work tools comprise pins that engage or integrate connection of the work tool to the quick coupler for operation with the work machine. Many pin-on work tools have different pin spreads, the distance between two pin centers of a pin-on work tool. Differing pin spreads are available for different work tools in the market and for work tools produced by different manufacturers.

Standard pin-grabber couplers only physically connect the work tool to the machine by using a primary or wedge locking element frictionally loaded against a work tool pin. A wedge style coupler utilizes a combination of wedge angle and friction coefficient to counteract the tendency of the working forces that would cause disengagement. The primary wedge in a standard coupler lacks an additional supplementary anti-release mechanism that aids in ensuring the wedge remains engaged with a pin of a work tool in the event of a loss of engagement force from the actuator.

Others have disclosed anti-release mechanisms, but fail to provide an anti-release mechanism on the primary wedge of a pin coupler. For example, US Publication No. 2018/0355579 discloses a locking device for a quick coupler for coupling the pin of an attachment to earth working machinery having a clamp device including a pivotable arm biased by a biasing means for preventing the wedge from becoming disengaged with the coupler. The clamp device requires a substantial arc shape and a spring on its end that provides a closing biasing force. The locking device and clamp device do not provide versatility to secure the wedge locking element to varying diameters of pins and pin spreads of work tools.

It can therefore be seen that a need exists for an improved anti-release mechanism which facilitates a supplementary locking mechanism for the primary wedge of a coupler to secure the work tool to the work machine in the event of a loss of engagement force.

SUMMARY OF THE DISCLOSURE

In accordance with one aspect of the disclosure, an anti-release mechanism of a pin-grabber coupler securing a work tool connected to a work machine is disclosed. The anti-release mechanism comprises an actuator, a wedge, a latch, a guide rod connecting the wedge and the latch, and a bias member on a first guide rod end of the guide rod biasing the latch and the wedge together. The wedge and the latch lock around a pin of the work tool and maintain the wedge against the pin of the work tool during a loss of engagement force.

In accordance with another aspect of the disclosure, a work machine is disclosed. The work machine comprises: a frame; a ground engaging element supporting the frame; an engine supported by the frame; a working mechanism extending from the frame; a pin-grabber coupler connected to the working mechanism; a work tool having a pin, the work tool being connected to the pin-grabber coupler; the pin-grabber coupler including a coupler frame, an anti-release mechanism, and an actuator. The anti-release mechanism includes: a wedge, a latch, a guide rod connecting the wedge and the latch, and a bias member on a first end of the guide rod biasing the latch and the wedge together. The wedge and the latch lock around the pin and maintain the wedge against the pin during a loss of engagement force.

In accordance with another aspect of the disclosure, a method of securing a work tool to a pin-grabber coupler of a work machine during a loss of engagement force is disclosed. The method comprising: providing the pin-grabber coupler including a pin grabber having an anti-release mechanism, a secondary engagement end, and an actuator connecting the anti-release mechanism and the secondary engagement end, the anti-release mechanism having a wedge, a latch, a guide rod connecting the wedge and the latch, and a bias member on the guide rod; actuating the actuator to extend the anti-release mechanism to a pin of the work tool; engaging the wedge against the pin and the latch around the opposite side of the pin; and maintaining a biasing force with the bias member keeping the wedge and latch engaged against the pin during a loss of engagement force.

These and other aspects and features of the present disclosure will be better understood upon reading the following detailed description when read in conjunction with the accompanying drawings.

The figures depict certain embodiments of the presented invention for purposes of illustration only. One skilled in the art will readily recognize from the following discussion that alternative embodiments of the structures and methods illustrated herein may be employed without departing from the principles described herein.

DETAILED DESCRIPTION

Figure 1:
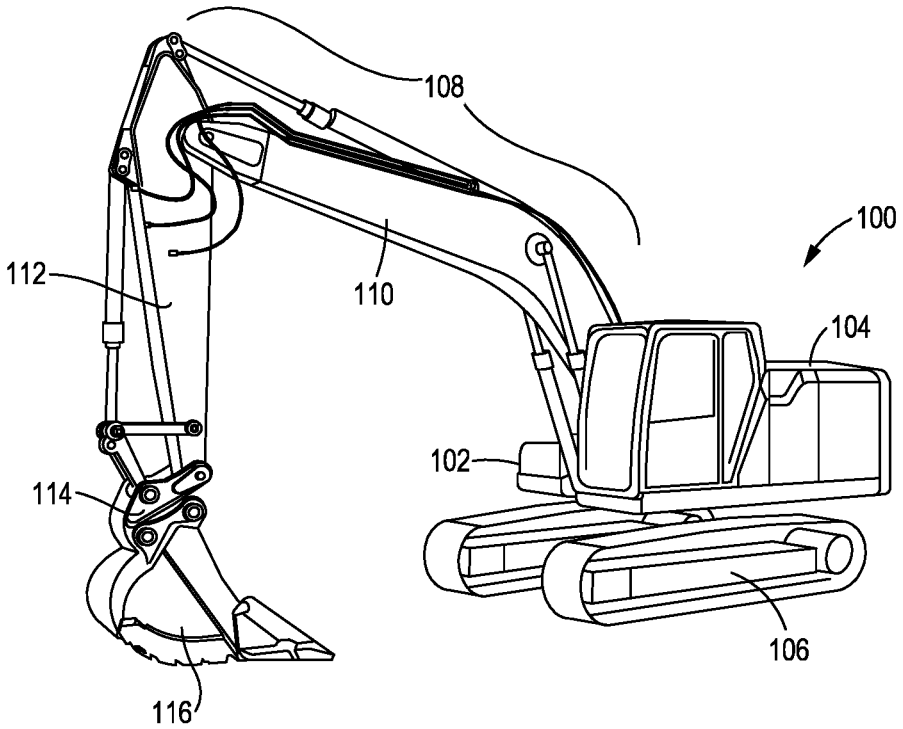
FIG. 1 is a perspective view of a work machine comprising a pin-grabber coupler coupled to a work tool, according to an embodiment of the present disclosure.

Referring now to the drawings, and with specific reference to FIG. 1, an exemplary work machine 100 is shown, illustrated as an excavator. Excavators are heavy equipment designed to move earth material from the ground or landscape at a dig site in the construction and agricultural industries. While the following detailed description describes an exemplary aspect in connection with the excavator, it should be appreciated that the description applies equally to the use of the present disclosure in other work machines including but not limited to backhoes, front-end loaders, skid steers, wheel loaders, tractors, and the like.

The work machine 100 comprises a frame 102 supporting an engine 104. The frame 102 is supported on ground engaging elements 106 illustrated as continuous tracks. It should be contemplated that the ground engaging elements 106 may be any other type of ground engaging elements 106 such as, for example, wheels, etc. The work machine 100 further includes a working mechanism 108 extending from the frame 102 for conducting work, such as, for example, excavating landscapes or otherwise moving earth, soil, or other material at a dig site. The frame 102 may be an upper swiveling body common with excavators and work machines in the agricultural and construction industries.

As illustrated in one embodiment, the working mechanism 108 includes a boom 110, an arm 112, a pin-grabber coupler 114, and a work tool 116 used to remove earth, soil, and other material from a landscape site. The work tool 116, also referred to as an implement, may be a bucket, dipper, hammer, thumb, hydromechanical tool, or other attachment that couples to the pin-grabber coupler 114 for operation by the work machine 100. The work tool 116 may also be a pin-on work tool that engages connection with the pin-grabber coupler 114.

The work machine 100 may utilize the pin-grabber coupler 114 to attach and detach the work tool 116 to the work machine 100. The work machine 100 can quickly actuate attachment and detachment of the work tool 116 to and from the pin-grabber coupler 114 by a hydraulic circuit, electrical circuit, and/or a computer-controller system provided on the work machine 100.

Figure 2:
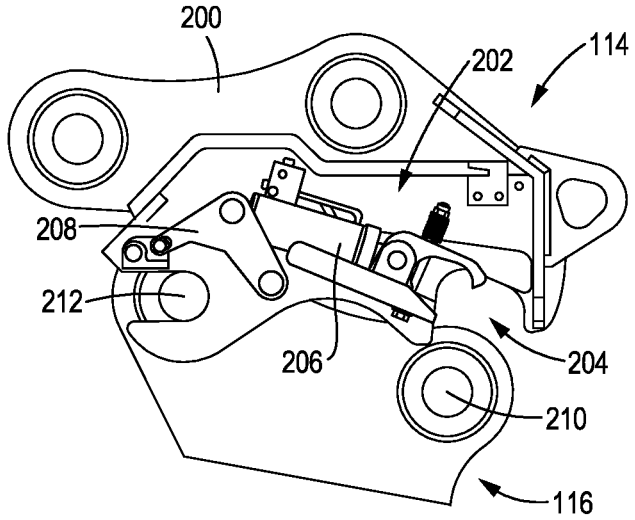
FIG. 2 is a side view of a pin-grabber coupler and a work tool, according to an embodiment of the present disclosure.

Referring now to FIG. 2, in one embodiment, the pin-grabber coupler 114 is illustrated unlocked and partially engaged with the work tool 116. The pin-grabber coupler 114 may include a coupler frame 200 and a pin grabber 202 having a primary engagement end 204, an actuator 206, and a secondary engagement end 208. The pin grabber 202 is integrated in the coupler frame 200. The primary engagement end 204 is connected to one end of the actuator 206 and the secondary engagement end 208 is connected to the other end of the actuator 206. The primary engagement end 204 engages a first pin 210 of a work tool 116 and the secondary engagement end 208 engages a second pin 212 of a work tool 116. The first pin 210 may also be referred as the "attachment pin" of a pin-on work tool. As shown in FIG. 2, the secondary engagement end 208 grabs the second pin 212 in side known as the "jaw" of the pin-grabber coupler 114.

Figure 3:
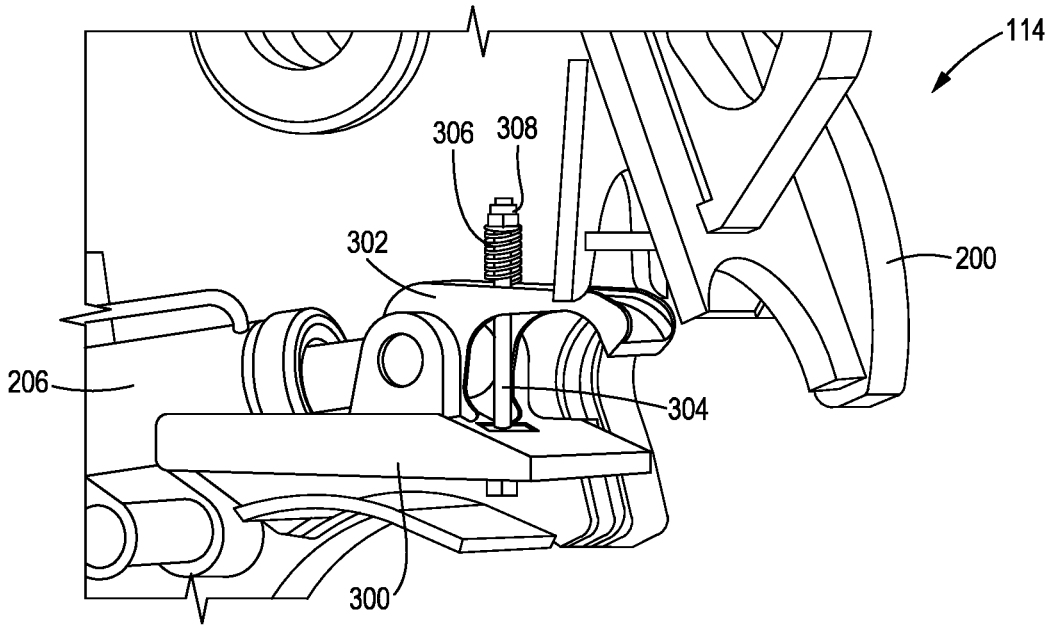
FIG. 3 is an enlarged perspective view of a portion of a pin-grabber coupler from the primary engagement end, according to an embodiment of the present disclosure.

Referring now to FIG. 3, in one illustrated embodiment, the primary engagement end 204 may comprise a wedge 300 and a latch 302 connected to the actuator 206. The primary engagement end 204 further includes a guide rod 304 that connects the wedge 300 to the latch 302 and is secured by a bias member 306 at one end of the guide rod 304. The guide rod 304 may be a bolt, a tie rod, an all thread, or the like. The bias member 306 may be secured on the guide rod 304 by a fastener 308. The fastener 308 may be a nut, or the like.

Figure 4:
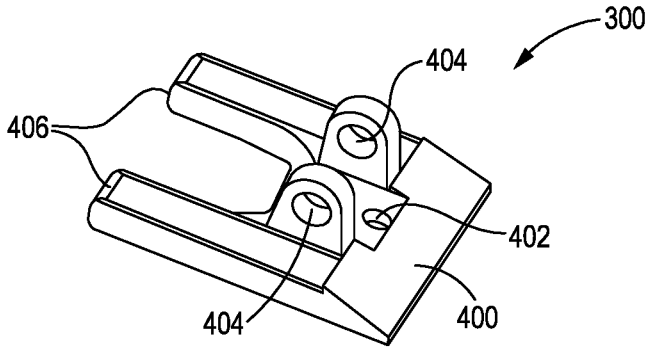
FIG. 4 is a perspective view of a wedge locking element, according to an embodiment of the present disclosure of the present disclosure.

Referring now to FIG. 4, in one illustrated embodiment, the wedge 300 may include a first wedge end 400, a wedge slot 402, a pair of first coupling slots 404 for connecting to the actuator 206 and/or the latch 302, and a second wedge end 406. The first wedge end 400 may be shaped like a flat or concave wedge, or have a sloping wedge surface, so that it maintains a load or engagement force against the first pin 210. The second wedge end 406 may be a U-shaped body that provides clearance for movement of the pin grabber 202 during attaching and detaching the pin-grabber coupler 114 to and from the work tool 116. The second wedge end 406 allows the wedge 300 to move around the actuator 206. The first wedge end 400 of the wedge 300 is shaped in a way to lock and engage into position against the first pin 210 when there is an engagement force maintained on the wedge 300. The secondary engagement end 208 may act as an anchor for maintaining the load on the wedge 300 and may be anchored on the second pin 212 of the work tool 116.

However, during operation of the work machine 100 significant load cases exerted on the pin-grabber coupler 114 may momentarily remove the load on the wedge 300 causing a loss of engagement force by the wedge 300 from the first pin 210. For example, a sudden event when the work tool 116 unexpectedly impacts an extremely hard or rock-like surface may be one such instance. As described herein, the primary engagement end 204 remains attached to the first pin 210 during a loss of engagement force. The latch 302 keeps the wedge 300 in place for situations where there is a loss of engagement from the wedge 300. Causes for a loss of engagement force could include a loss of work machine 100 electrical or engine power or a partial/total failure to key components within the work machine 100. When the wedge 300 loses its engagement force, the wedge 300 relies on a frictional force for remaining in place. There may be situations when the operator of a work machine 100 creates hard impacts or rattles which momentarily removes the load from the wedge 300 allowing for the wedge 300 to lose its frictional holding force. With the addition of the latch 302, the wedge 300 has a supplementary holding force to keep the wedge 300 engaged.

Figure 5:
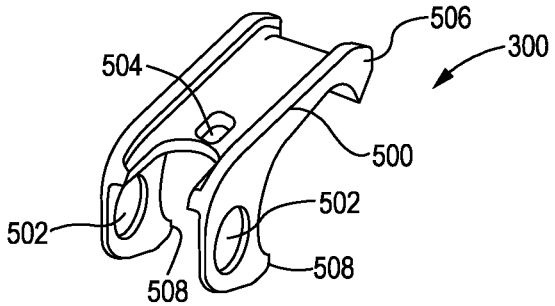
FIG. 5 is a perspective view of a latch, according to an embodiment of the present disclosure.

Referring now to FIG. 5, in one illustrated embodiment, the latch 302 is responsible for keeping the wedge 300 engaged on the first pin 210 at all times allowing the wedge 300 to be able to frictionally lock up whenever the wedge 300 becomes loaded. The latch 302 is responsible for latching onto the first pin 210 of the work tool 116 during the engagement process of the wedge 300. The latch 302 is responsible for keeping the wedge 300 of the pin-grabber coupler 114 engaged to the first pin 210 of the work tool 116 in the event of a loss of engagement force by the actuator 206. The latch 302 comprises an elongated body 500 having a pair of second coupling slots 502 that integrates connection with the actuator 206 and the pair of first coupling slots 404 which may create a pivot point for the latch 302. The latch 302 may be connected to the wedge 300 and the actuator 206 by a fastener, retaining pin, press fitting pin, or other method generally known in the arts. The wedge 300 and the latch 302 may be pivotally coupled to allow the latch 302 to pivotally move the latch head 506 radially open or closed relative to the wedge 300. The latch also comprises a latch slot 504 in the elongated body 500 and a latch head 506.

The guide rod 304 connects the wedge 300 to the latch 302 via the wedge slot 402 and the latch slot 504. As illustrated, the bias member 306 is secured on the guide rod 304 on the side of the latch 302 away from the wedge 300. It will be recognized by one having ordinary skills in the arts that the bias member 306 may be situated on the guide rod 304 on the side of the wedge 300 away from the latch 302.

The bias member 306 provides a biasing force against the latch 302 towards the wedge 300, or vice versa. The fastener 308 which secures the bias member 306 onto the guide rod 304 controls the biasing force of the bias member 306 against the latch 302. The bias member 306 forces movement of the latch 302 towards the wedge 300, or vice versa. The bias member 306 is depicted as a coil spring, but any other type of spring or biasing member may be used such as a strut isolator, strut, shock, or the like.

The latch 302 may further comprise a toe geometry feature 508 that supports preventing the latch 302 from closing too far from the biasing force. The toe geometry feature 508 helps prevent the latch 302 from over-pivoting which may result in the latch 302 not being able to clear the first pin 210.

Figure 6:
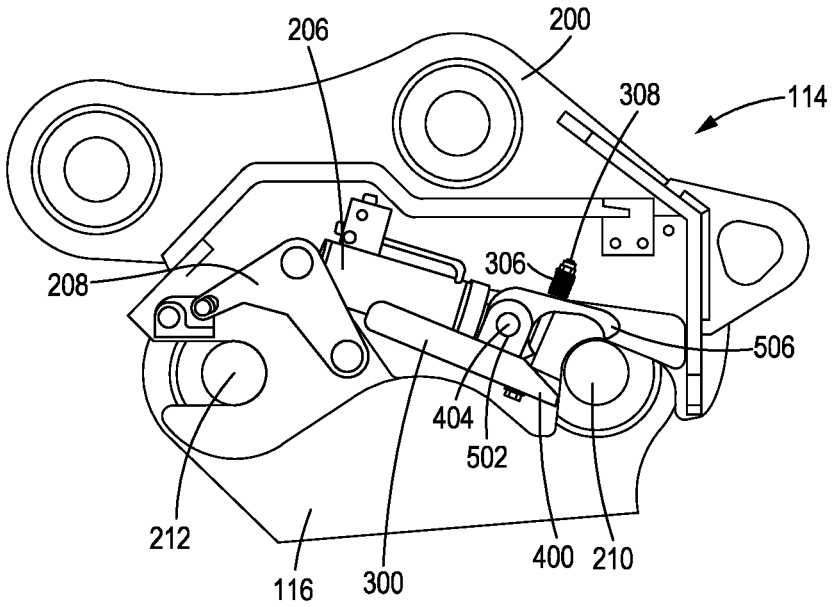
FIG. 6 is a side view of an anti-release mechanism of a pin-grabber coupler connecting to a work tool, according to an embodiment of the present disclosure.
Figure 7:
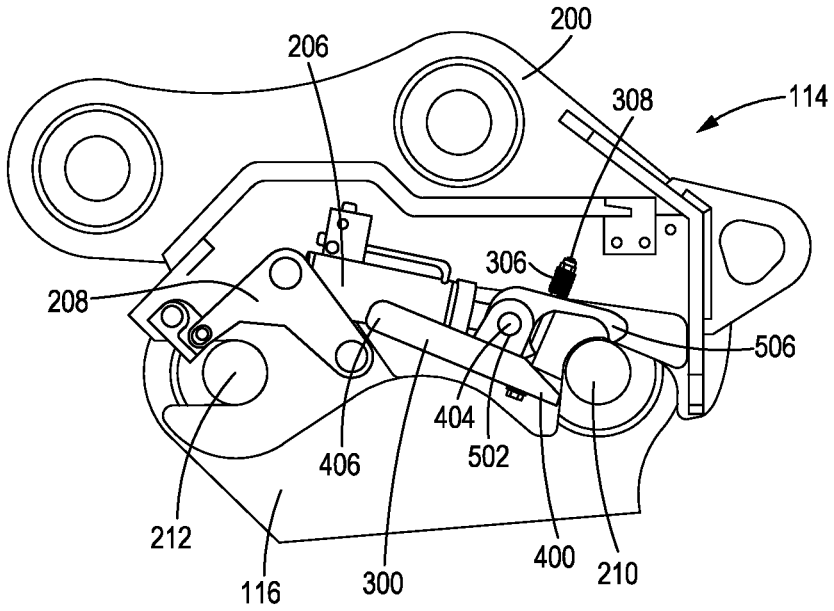
FIG. 7 is a side view of an anti-release mechanism of a pin-grabber coupler in position to lock around a pin of a work tool, according to an embodiment of the present disclosure.

Now turning to FIGS. 6-7, in an illustrated embodiment, the actuator 206 actuates engagement of the pin grabber 202 to the first pin 210 of the work tool 116. When actuated, the actuator 206 extends or retracts a rod 600 from within the actuator 206. The actuator 206 may be controlled by a hydraulic circuit, electric pneumatic, or other actuator generally known in the arts. The actuator 206 may be controlled by an operator, generally in the cab of a work machine 100, utilizing a switch connected to a hydraulic circuit, electrical circuit, or computer-controller provided on the work machine 100. The actuator 206 may comprise a check valve for regulating, or checking the pressure of, the load of the engagement force applied against the wedge 300. The check valve holds the resulting retraction force applied to the wedge 300. The actuator 206 may control the retraction and extension of the rod 600 inside the actuator 206, which can increase or decrease the load applied.

Figure 8:
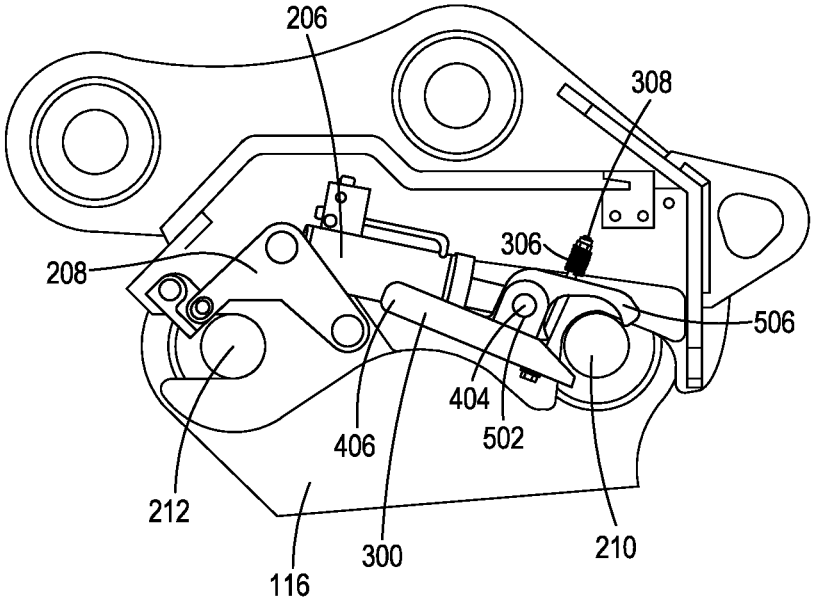
FIG. 8 is a side view of an anti-release mechanism of a pin-grabber coupler with a wedge extending and a latch engaging a pin of a work tool, according to an embodiment of the present disclosure.
Figure 9:
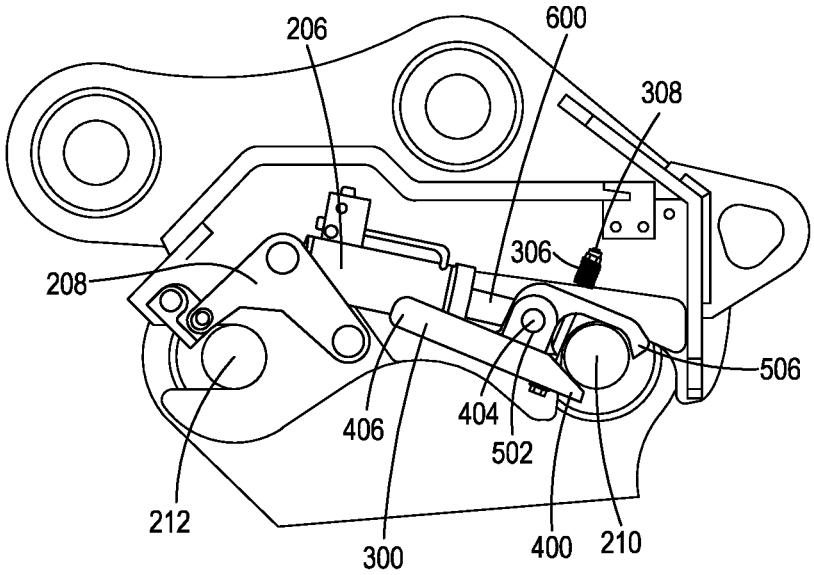
FIG. 9 is a side view of an anti-release mechanism of a pin-grabber coupler with the wedge and latch fully locked onto a pin of a work tool, according to an embodiment of the present disclosure.

As illustrated in FIG. 2 and in FIGS. 6-9, in one embodiment of engaging the work tool 116, the engagement of the pin grabber 202 to the first pin 210 may occur when the actuator 206 is actuated to extend the rod 600 outwardly, thereby extending the latch head 506 of the latch 302 over the first pin 210 of the work tool 116. As shown in FIG. 6, the first pin 210 is engaged within the pin-grabber coupler 114 near the primary engagement end 204 to engage the first pin 210. The secondary engagement end 208 is illustrated engaged onto the second pin 212 of the work tool 116. The secondary engagement end 208 may act as an anchor by supporting the engagement force required for locking the wedge 300 against the first pin 210. The secondary engagement end 208 may include a rocker that is formed to integrate onto the second pin 212. The rocker may be triangular in shape to engage the second pin 212 and provide an anchor support to maintain the frictional load of the wedge 300 on the first pin 210. FIG. 7 illustrates the pin grabber 202, wedge 300, and latch 302 in locked position and extending towards the first pin 210. FIG. 8 shows the wedge 300 extending towards the first pin 210 and the latch 302 engaging the first pin 210 once the actuator 206 has been actuated. The wedge 300 is illustrated extending with the latch 302 to engage the first pin 210. FIG. 9 illustrates the wedge 300 and the latch 302 fully locked onto the first pin 210 of the work tool 116.

As illustrated in FIGS. 6-9, the wedge 300 and latch 302 are in position to lock and engage the first pin 210 as the rod 600 is extended from within the actuator 206 towards the first pin 210. In FIGS. 6-7, the latch head 506 rolls over the first pin 210 when the rod 600 is actuated to extend outward from within the actuator 206. The bias member 306 provides a closing biasing force against the latch 302 towards the wedge 300. The closing biasing force is maintained while the rod 600 extends the wedge 300 to engage the first pin 210. The latch head 506 has a hook geometry feature that allows the latch 302 to act against force of the bias member 306 to pivot away from the wedge 300 and roll over the first pin 210 during attachment. The hook geometry may be triangular in shape with concave sides to facilitate the rolling or sliding over of the first pin 210, as generally known by a person having ordinary skill in the arts. This occurs when the latch head 506 contacts the first pin 210 with the hook geometry of the latch head 506.

When the wedge 300 and latch 302 are secured around the first pin 210, the latch 302 will act as a supplemental anti-release mechanism so that the pin-grabber coupler 114 does not disconnect from the work tool 116 in the event of a loss of engagement force.

Figure 10:
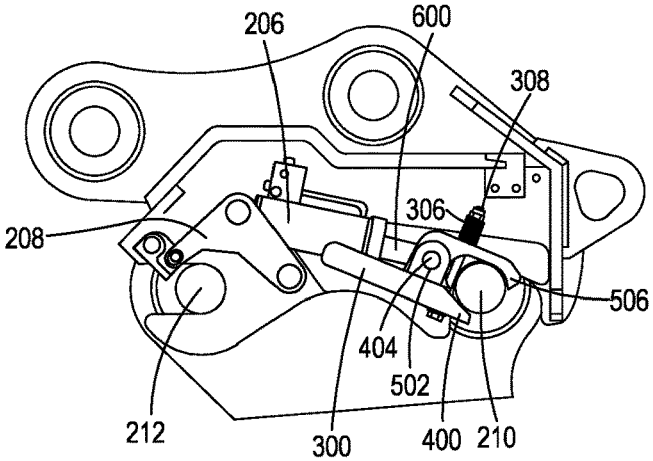
FIG. 10 is a side view of an anti-release mechanism of a pin-grabber coupler with the wedge and latch fully locked onto a pin of a work tool prior to unlocking, according to an embodiment of the present disclosure.
Figure 11:
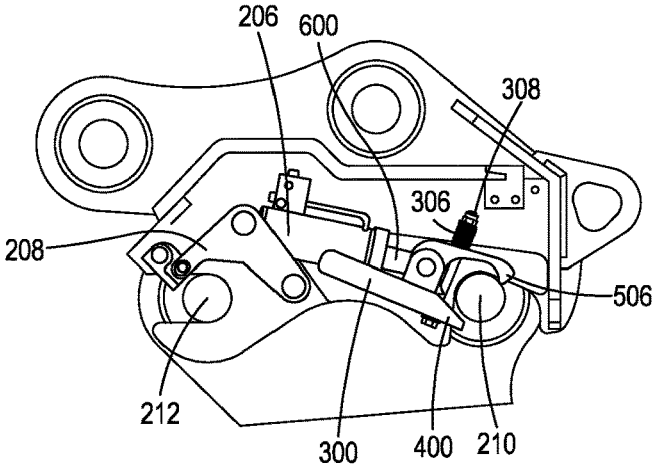
FIG. 11 a side view of an anti-release mechanism of a pin-grabber coupler retracting and disengaging from a work tool, according to an embodiment of the present disclosure.
Figure 12:
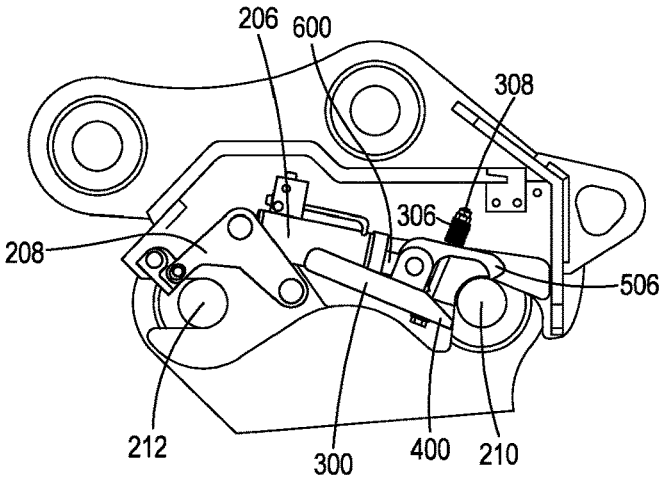
FIG. 12 a side view of an anti-release mechanism of a pin-grabber coupler with the wedge disengaged from a work tool, according to an embodiment of the present disclosure.
Figure 13:
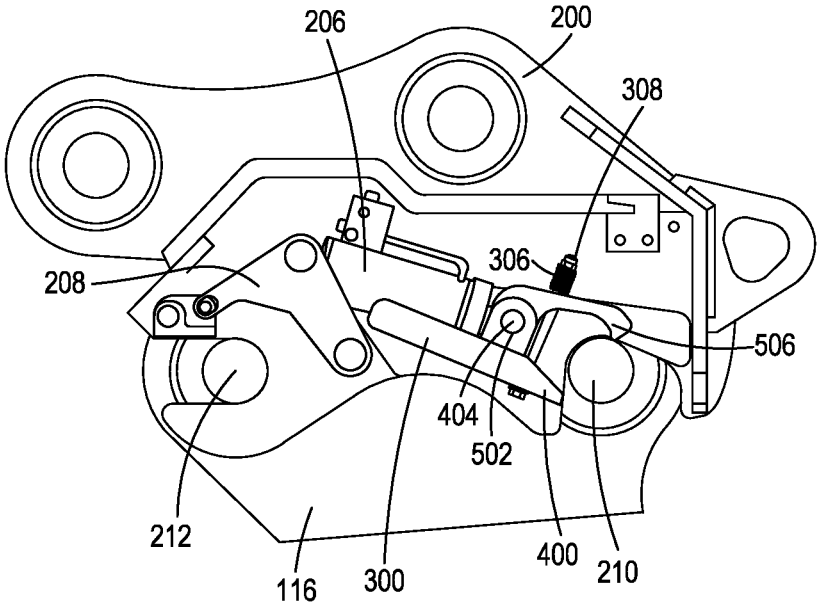
FIG. 13 a side view of an anti-release mechanism of a pin-grabber coupler fully unlocked from a work tool, according to an embodiment of the present disclosure.
Figure 14:
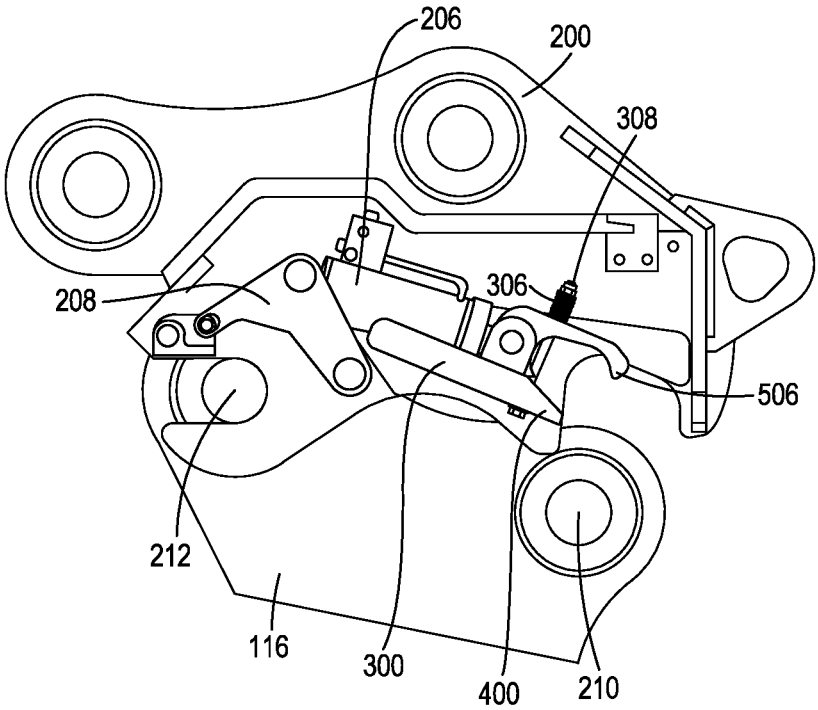
FIG. 14 a side view of a pin of a work tool removed from a slot of a pin-grabber coupler after disconnecting an anti-release mechanism the work tool, according to an embodiment of the present disclosure.

Referring now to FIGS. 10-14, in one embodiment, the pin-grabber coupler 114 is illustrated unlocking/disconnecting from the work tool 116. FIG. 10 illustrates the wedge 300 and the latch 302 fully engaged onto the first pin 210 prior to retraction by the actuator 206. FIG. 11 illustrates the wedge 300 retracting and the latch 302 disengaging the first pin 210. FIG. 12 illustrates the wedge 300 fully disengaged from the first pin 210. FIG. 13 illustrates the pin-grabber coupler 114 fully unlocked. FIG. 14 illustrates the secondary engagement end 208 disengaging from the second pin 212 from a slot of the pin-grabber coupler 114. When the rod 600 is retracted by actuating the actuator 206, the wedge 300 retracts and disengages the first pin 210. The latch head 506 rolls over the first pin 210 and against the force of the bias member 306 when the rod 600 retracts into the actuator 206, as shown in FIG. 12.

As shown in FIGS. 13-14, the latch 302 is illustrated disengaged from the first pin 210, and the pin-grabber coupler 114 is unlocked from the work tool 116. The first pin 210 can be removed from the jaw of the pin-grabber coupler 114. The secondary engagement end 208 can then be removed from the second pin 212 of the pin-grabber coupler 114.

Figure 15:
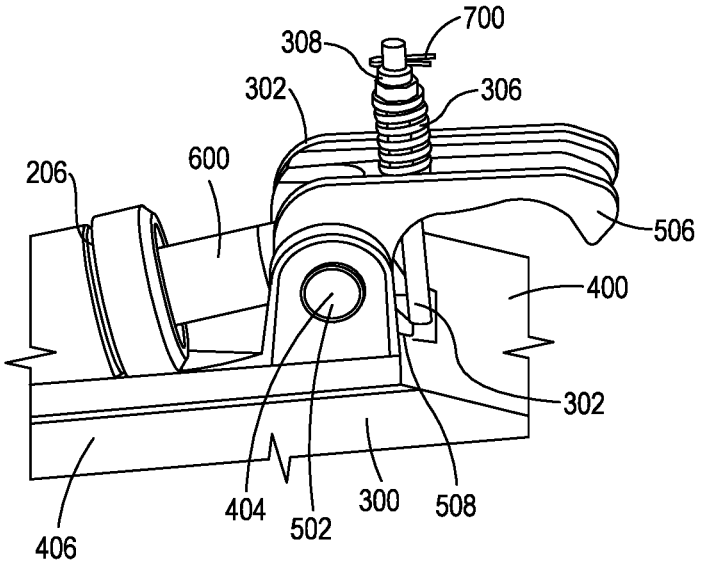
FIG. 15 is a perspective view of an anti-release mechanism of a pin-grabber coupler, according to another embodiment.
Figure 16:
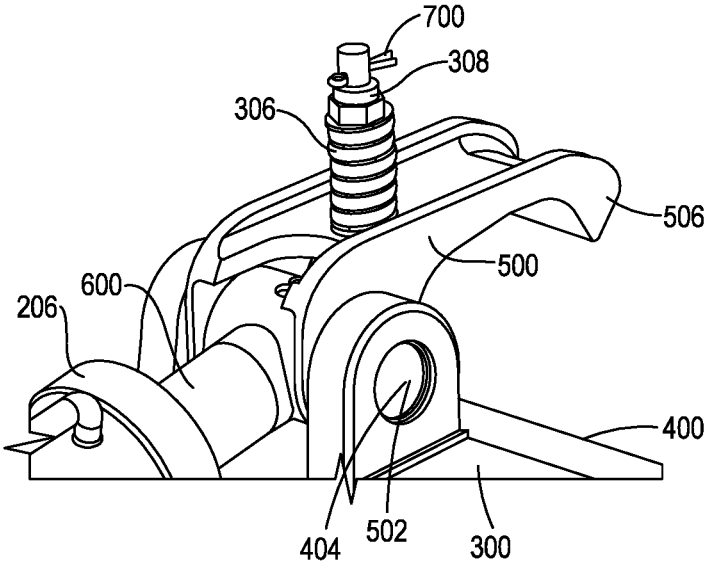
FIG. 16 is a perspective view of an anti-release mechanism of a pin-grabber coupler, according to another embodiment.

Referring now to FIGS. 15-16, in another illustrated embodiment, the guide rod 304 may comprise a retaining pin 700 installed in a retaining hole in the guide rod 304. The location of the retaining hole on the guide rod 304 ensures a desired or pre-determined closing force by the bias member 306 during assembly of the retaining pin 700 in the guide rod 304. FIG. 15 illustrates the primary engagement end 204 including with the retaining pin 700 installed on the guide rod 304. FIG. 16 illustrates the primary engagement end 204 from another side view with the retaining pin 700 installed on the guide rod 304. The retaining pin 700 may be a cotter pin, a cotter hair, a lynch pin, a roll pin, a hand ring, a detent ball pin, a wire snap, or other retaining pin generally known in the arts.

The retaining pin 700 supports controlling the desired biasing force from the bias member 306 when installed on the guide rod 304. The through-hole for the retaining pin 700 may be positioned on the guide rod 304 so that the fastener 308 is installed at a pre-determined length securing the pre-loaded/pre-determined biasing force of the bias member 306 with the retaining pin 700. The retaining pin 700 ensures the required force of the bias member 306 is properly installed on the guide rod 304 for the proper work machine 100 application. The retaining pin 700 also ensure that the fastener 308 remains in place and the fastener 308 is prevented from loosening to prevent the biasing force of the bias member 306 from weakening.

Figure 17:
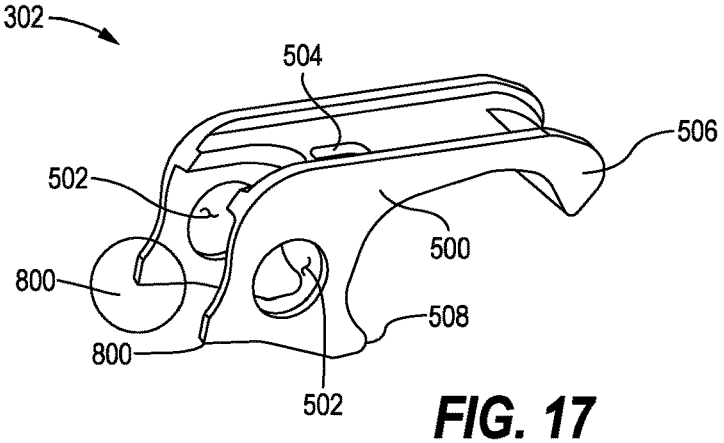
FIG. 17 is a perspective view of a latch of an anti-release mechanism, according to another embodiment of the present disclosure

As shown in FIGS. 17-21, additional embodiments of the latch 302 are illustrated. As illustrated in FIG. 17, the latch 302 may comprise a heel geometry feature 800 that provides a lifting force of the latch head 506 to pivotally open up the latch 302 for clearing the first pin 210 when actuated by the actuator 206. When actuating the actuator 206, a position at an extension or retraction of the actuator 206 causes the heel geometry feature 800 to provide a lifting force when the rod 600 is extended or retracted from the actuator 206. The heel geometry feature 800 supports opening up the latch 302 so that the latch head 506 can clear the first pin 210 during locking and/or unlocking of the pin-grabber coupler 114 from the work tool 116. The heel geometry feature 800 may comprise a geometric feature that prevents over-rotating of the latch 302 and/or limits the closing of the latch 302. The toe geometry feature 508 may also comprise a geometric shaped feature that prevents over-rotating of the latch 302 and/or limits the closing of the latch 302.

Figure 18:
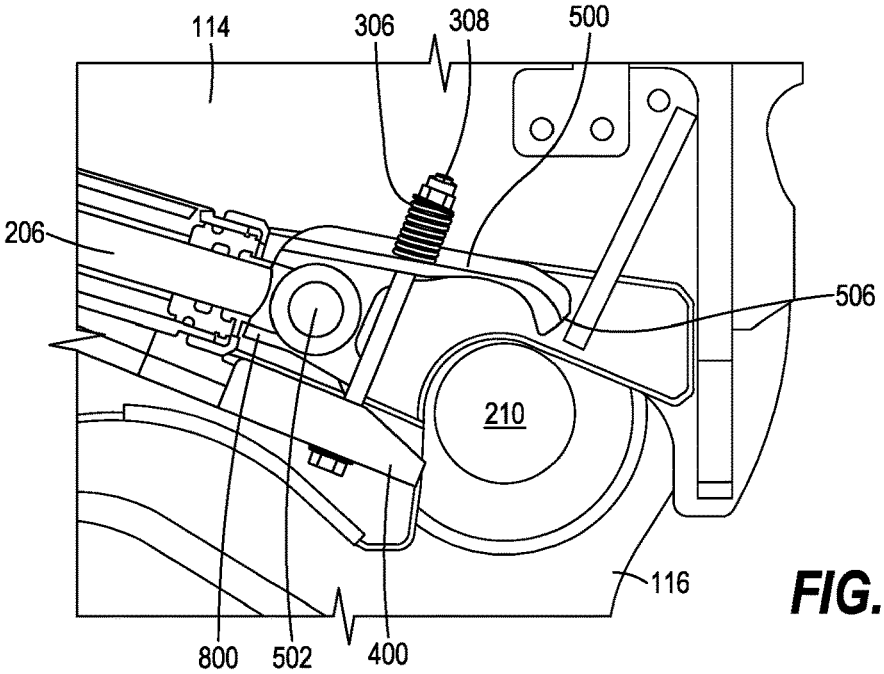
FIG. 18 is a side view of an anti-release mechanism with a latch having a heel geometry to support locking around a pin, according to another embodiment of the present disclosure

As illustrated in FIG. 18, the heel geometry feature 800 provides a lifting force for the latch 302 at a position when the latch 302 is extended towards the first pin 210. When the latch 302 reaches the position the latch head 506 is lifted above the first pin 210 to create space between the latch head 506 and the first pin 210 so that the latch 302 can clear the first pin 210 to form a lock around the first pin 210.

Figure 19:
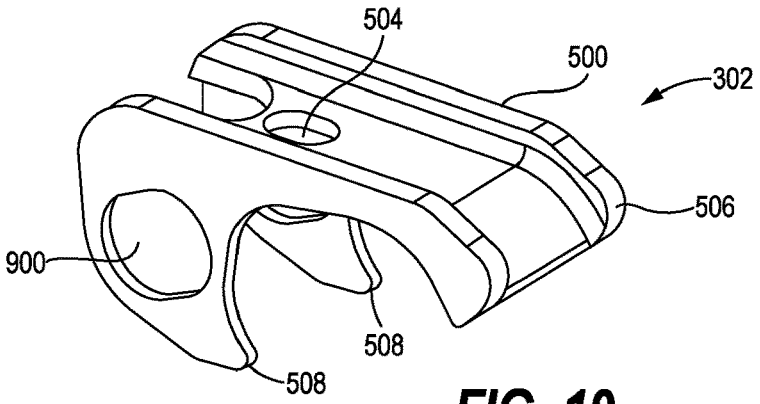
FIG. 19 is a perspective view of a latch of an anti-release mechanism, according to another embodiment of the present disclosure.
Figure 20:
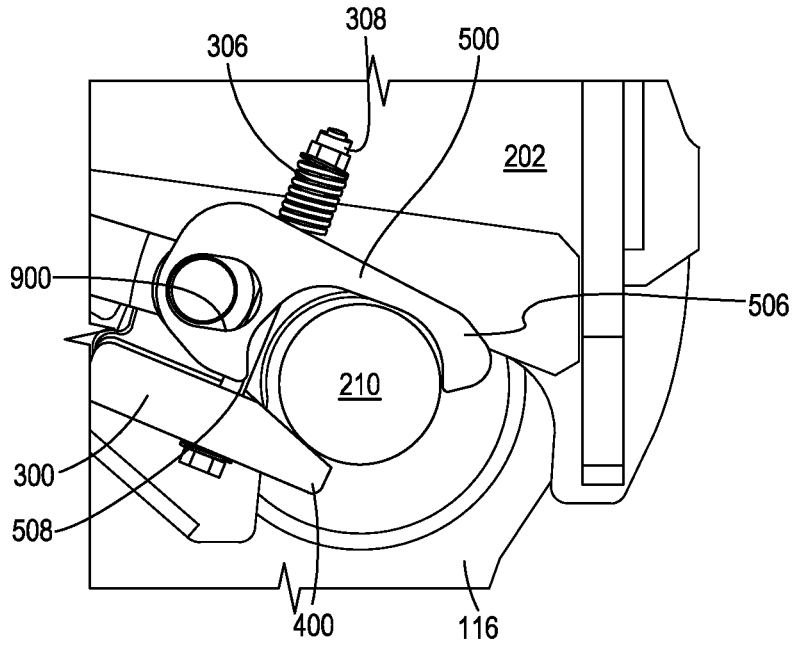
FIG. 20 is a fragmented side view of an anti-release mechanism with an adjustable latch locked around a pin of a work tool with a larger diameter, according to another embodiment of the present disclosure.

Now referring to FIG. 19, in one embodiment, the latch 302 is illustrated with a pair of elongated coupling slots 900 that replace the pair of second coupling slots 502, which are more circular in geometry. The pair of elongated coupling slots 900 allows movement of the latch 302 relative to the wedge 300, while remaining pivotally connected to the wedge 300, as shown in FIGS. 19-20. The pair of elongated coupling slots 900 provides the latch 302 with more clearance operability so that the latch head 506 can surround and lock to the first pin 210 with varying diameters. The latch 302 may be integrally connected to the rod 600 of the actuator 206 with the wedge 300 creating a pivot point for the latch 302 so that the latch head 506 may move radially to open or close relative towards the wedge 300. As shown in FIG. 18, the pair of elongated coupling slots 900 allow movement of the latch 302 at the pivot point with the wedge 300 and the rod 600. The latch slot 504 may be provided or positioned at an angle which causes the latch to retract from the force of the bias member 306. The latch slot 504 may also be elongated to provide for clearance for movement of the guide rod 304.

Figure 21:
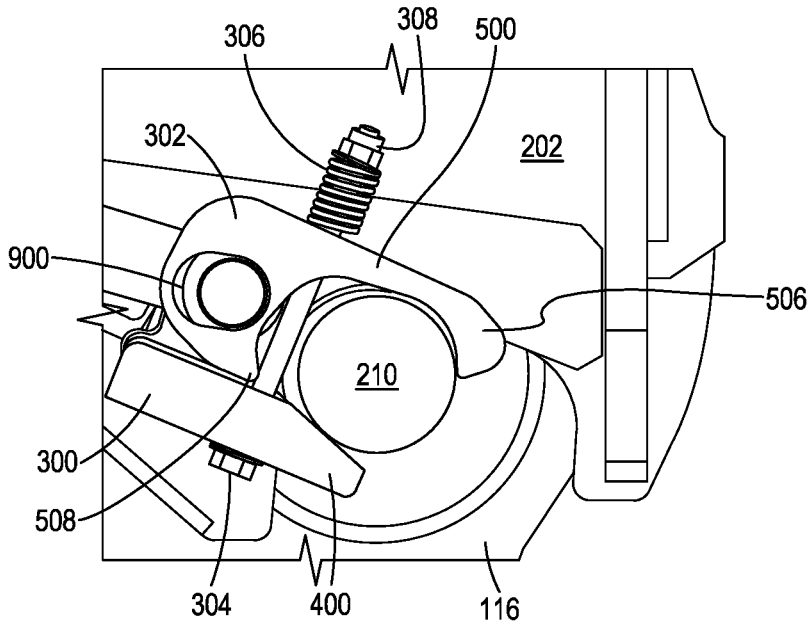
FIG. 21 is a fragmented side view of an anti-release mechanism with an adjustable latch locked around a pin of a work tool with a smaller diameter, according to another embodiment of the present disclosure

FIG. 20 illustrates the wedge 300 and the latch 302 engaging the first pin 210 with a larger diameter, whereas FIG. 21 illustrates the wedge 300 and the latch 302 engaging the first pin 210 with a smaller diameter. The pair of elongated coupling slots 900 provided at the pivot point with the wedge 300 allows the latch 302 to "reach out" or contract in order to support locking on different diameters of the first pin 210 of the work tool 116.

INDUSTRIAL APPLICABILITY

In operation, the present disclosure may find applicability in many industries including, but not limited to, the construction, earth-moving, and agricultural industries. Specifically, the technology of the present disclosure may be used for work tool securement to work machines including, but not limited to, excavators, backhoes, skid steers, wheel loaders, tractors, and the like. For example, the teaching of this disclosure can be advantageously employed with a quick coupler for easily connecting and disconnecting work tools such as hammers, buckets, dippers, dig tools, and the like. While the foregoing detailed description is made with specific reference to excavators, it is to be understood that its teachings may also be applied onto the other work machines such as backhoes, skid steers, wheel loaders, tractors, mulchers, and the like that utilize a coupler for connecting to work tools.

It may also be recognized to a person skilled in the arts that the foregoing anti-release system may be provided as a kit for an anti-release mechanism for installing onto a wedge locking element utilized by a wide range of machine sizes and machine types. This anti-release mechanism disclosed herein will allow the operator of the work machine 100 to be able to maintain the wedge 300 of a pin-grabber coupler 114 engaged to the first pin 210 of the work tool 116 during a loss of engagement force. The actuating of the actuator 206 of the pin grabber 202 can be operated from the comfort of the cab with a minimal amount of effort by using a hydraulic circuit, electric pneumatic, or a computer-controller system provided in the work machine 100, as generally known in the arts. The anti-release mechanism consists of configuring the primary engagement end 204 of the pin grabber 202 with the wedge 300, the latch 302, the guide rod 304, and the bias member 306.

Figure 22:
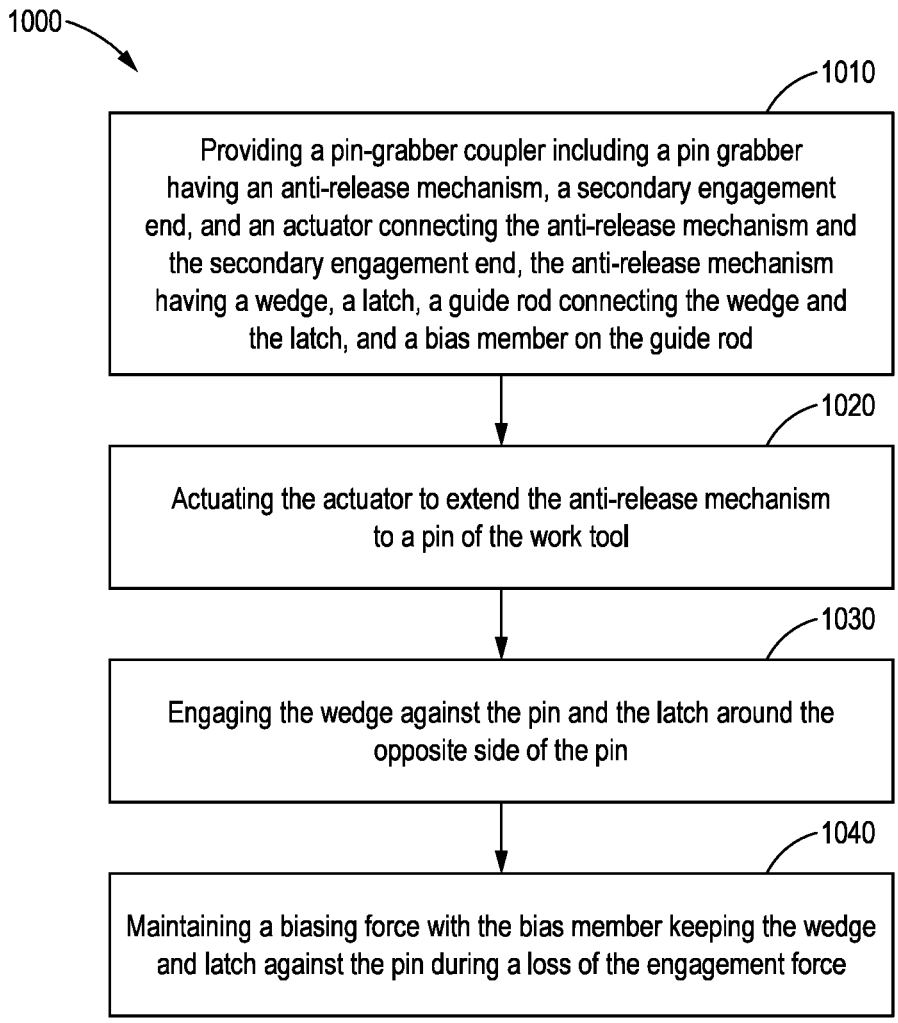
FIG. 22 is a flow chart of a method of installing an anti-release mechanism for a wedge of a pin-grabber coupler of a work machine, according to an embodiment of the disclosure of the present disclosure.

Referring now to FIG. 22, in one embodiment, a method 1000 of securing a work tool 116 to a pin-grabber coupler 114 of a work machine 100 during a loss of engagement force is disclosed. The method 1000 comprises, first in a step 1010, providing the pin-grabber coupler 114 including the pin grabber 202 having the anti-release mechanism, a secondary engagement end 208, and the actuator 206 connecting the anti-release mechanism and the secondary engagement end 208, the anti-release mechanism having the wedge 300, the latch 302, the guide rod 304 connecting the wedge 300 and the latch 302, and the bias member 306 on the guide rod 304. The guide rod 304 may be installed in the wedge slot 402 and latch slot 504 to connect the wedge 300 and the latch 302 so that the bias member 306 provided on the guide rod 304 provides a closing force of the latch 302 towards the wedge 300. The bias member 306 may be secured on the guide rod 304 with a fastener 308. The guide rod 304 may also be provided with a through-hole proximate to a first end of the guide rod 304. The through-hole is positioned on the guide rod 304 so that after installing the bias member 306, a retaining pin 700 may be inserted in the through-hole to meet a pre-determined or required biasing force of the bias member 306 for securing the wedge 300 and the latch 302 against the first pin 210.

In a step 1020, the actuator 206 is actuated to extend the anti-release mechanism to the first pin 210 of the work tool 116. In a step 1030, the wedge 300 engages the first pin 210 and the latch 302 engages around the opposite side of the first pin 210. Next, in step 1040, the bias member 306 maintains a biasing force to keep the wedge 300 and latch 302 against the first pin 210 during a loss of engagement force. The closing biasing force is maintained around the first pin 210 by the bias member 306 forcing closure of the latch 302 and the wedge 300 around the first pin 210 during a momentarily unlocking of the wedge 300 against the first pin 210.

The wedge 300 and the latch 302 may be connected with the guide rod 304 via the wedge slot 402 and latch slot 504. Further, the method 1000 may further include providing a latch head 506 having a hook geometry that allows the latch head 506 to roll over the first pin 210 and exert a force against the bias member 306 when the latch 302 engages or disengages the first pin 210, and actuating the actuator 206 to extend or retract the anti-release mechanism to engage or disengage the first pin 210.

The latch 302 may be provided with the toe geometry feature 508 on the latch 302 to prevent over-rotation or over-pivoting of the latch 302 when the actuator 206 is actuated to engage the anti-release mechanism with the first pin 210. The latch 302 may be further provided with the heel geometry feature 800 on the latch 302 to facilitate a pivotable locking clearance of the first pin 210 when the actuator 206 is actuated to engage the anti-release mechanism with the first pin 210.

The anti-release mechanism of the pin grabber 202 of the pin-grabber coupler 114 provides an added advantage of protecting the longevity of a work tool in the event of a loss of engagement force occurring to the actuator 206 of the pin-grabber coupler 114 during operation by the work machine. It is desirable that a coupling and uncoupling anti-release function be provided onto existing work machines utilizing pin-grabber couplers to protect pin-type work tools from disengaging from the pin-grabber coupler during a loss of engagement.

From the foregoing, it can be seen that the technology disclosed herein has industrial applicability in a variety of settings such as, but not limited to work machines in the construction and agricultural industries that utilize a coupler for connecting to various work tools.

What is claimed is:

1. An anti-release mechanism of a pin-grabber coupler securing a work tool connected to a work machine, the anti-release mechanism comprising:

an actuator;

a wedge having a wedge slot;

a latch having a latch slot;

a guide rod connecting the wedge and the latch through the wedge slot and the latch slot; and a bias member on a first guide rod end of the guide rod biasing the latch and the wedge together, the wedge and the latch locking around a pin of the work tool and securing the wedge against the pin of the work tool during a loss of an engagement force.

2. The anti-release mechanism of claim 1, wherein the actuator being controlled by one chosen from the group consisting of a computer-controller system, electric pneumatic, and a hydraulic circuit system.

3. The anti-release mechanism of claim 2, wherein the latch is pivotally coupled with the wedge and includes at least one geometric feature chosen from the group consisting of:

a heel geometry feature that provides a lifting force when the actuator is actuated;

a toe geometry feature that prevents the latch from over-pivoting;

a latch head having a hook geometry feature that allows the latch head to roll over the pin and exert a force against the bias member when the latch engages or disengages the pin; and a pair of elongated coupling slots that allows movement of the latch while pivotally connected with the wedge.

4. The anti-release mechanism of claim 2, wherein the anti-release mechanism further includes a secondary engagement end engaging a second pin of the work tool.

5. The anti-release mechanism of claim 1, wherein the guide rod includes a fastener and a through-hole proximate to the first guide rod end of the guide rod, the through-hole being positioned on the guide rod and maintained with a retaining pin to provide a preloaded desired biasing force of the bias member.

6. The anti-release mechanism of claim 5, the guide rod being one selected from the group consisting of a bolt, a tie rod, an all thread, and a mechanical fastener.

7. The anti-release mechanism of claim 5, the retaining pin is one selected from the group consisting of a cotter pin, a cotter hair, a lynch pin, a roll pin, a hand ring, a detent ball pin, and a wire snap.

8. The anti-release mechanism of claim 1, the anti-release mechanism further includes the wedge slot, the latch slot, and the guide rod being positioned in the wedge slot and the latch slot connecting the wedge and the latch, the bias member being provided on the first guide rod end of the guide rod.

9. The anti-release mechanism of claim 1, wherein the bias member is one selected from the group consisting of a spring, a strut isolator, a strut, and a shock.

10. The anti-release mechanism of claim 1, the actuator further includes a check valve for regulating and measuring the engagement force.

11. The anti-release mechanism of claim 1, the actuator is a cylinder having a rod that extends and retracts from the cylinder when actuated.

12. A work machine comprising:

a frame;

a ground engaging element supporting the frame;

an engine supported by the frame;

a working mechanism extending from the frame;

a pin-grabber coupler connected to the working mechanism;

a work tool having a pin, the work tool being connected to the pin-grabber coupler; the pin-grabber coupler including a coupler frame, an anti-release mechanism, and an actuator;

the anti-release mechanism including:

a wedge having a wedge slot, a latch having a latch slot, a guide rod connecting the wedge and the latch through the wedge slot and the latch slot, and a bias member on a first end of the guide rod biasing the latch and the wedge together, the wedge and the latch locking around the pin and securing the wedge against the pin during a loss of an engagement force.

13. The work machine of claim 12, the pin-grabber coupler further includes a secondary engagement end, the secondary engagement end anchoring against a second pin of the work tool.

14. The work machine of claim 12, wherein the actuator includes a check valve and being controlled by one selected from the group consisting of a computer-controller system, electric pneumatic, and a hydraulic circuit system provided in the work machine.

15. The work machine of claim 12, wherein the latch is pivotally coupled with the wedge and includes at least one geometric feature chosen from the group consisting of:

a heel geometry feature that provides a lifting force when the actuator is actuated;

a toe geometry feature that prevents the latch from over-pivoting;

a latch head having a hook geometry feature that allows the latch head to roll over the pin and exert a force against the bias member when the latch engages or disengages the pin; and a pair of elongated coupling slots that allows movement of the latch while pivotally connected with the wedge.

16. The work machine of claim 12, wherein the guide rod includes a fastener and a through-hole proximate to the first end of the guide rod, the through-hole being positioned on the guide rod and maintained with a retaining pin to provide a pre-determined biasing force of the bias member, the guide rod connecting the wedge and the latch via the wedge slot and the latch slot, the latch including a pair of elongated coupling slots, and the latch slot being positioned at an angle causing the biasing force to retract the latch.

17. A method of securing a work tool to a pin-grabber coupler of a work machine during a loss of an engagement force, the method comprising:

providing the pin-grabber coupler including a pin grabber having an anti-release mechanism, a secondary engagement end, and an actuator connecting the anti-release mechanism and the secondary engagement end, the anti-release mechanism having a wedge having a wedge slot, a latch having a latch slot, a guide rod connecting the wedge and the latch through the wedge slot and the latch slot, and a bias member on the guide rod;

actuating the actuator to extend the anti-release mechanism to a pin of the work tool;

engaging the wedge against the pin and the latch around the opposite side of the pin; and maintaining a biasing force with the bias member keeping the wedge and latch engaged against the pin during a loss of the engagement force.

18. The method of claim 17, the method further including:

providing a latch head having a hook geometry feature that allows the latch head to roll over the pin and exert a force against the bias member when the latch engages or disengages the pin; and actuating the actuator to extend or retract the anti-release mechanism to engage or disengage the pin.

19. The method of claim 17, the method further including providing a heel geometry feature on the latch to facilitate a locking clearance when the actuator is actuated to engage or disengage the pin.

* * * * *